235-382 SR

OR 3,976,974

United State

Hinohara et al.

[11] 3,976,974

[45] Aug. 24, 1976

[54] CARD-CONTROLLED LOCK INSTALLATIONS INCLUDING MATRIX CIRCUITS

[75] Inventors: Kango Hinohara; Makoto Nishikawa; Noriaki Yokomoto; Kenichi Matsumura, all of Hiroshima, Japan

[73] Assignee: Kabushiki Kaisha Kumahira Seisakusho, Japan

[22] Filed: Dec. 27, 1974

[21] Appl. No.: 537,109

[30] Foreign Application Priority Data

Dec. 29, 1973 Japan ..... 49-3772
Dec. 29, 1973 Japan ..... 49-3773

[52] U.S. Cl. ..... 340/149 A; 340/274 C; 340/166 R

[51] Int. Cl.[2] ..... H04G 3/00

[58] Field of Search ..... 340/149 A, 274 C, 149 R; 235/61.7 B, 61.7, 61.11; 179/2 CA; 70/277, 278

[56] References Cited

UNITED STATES PATENTS 3,104,314 9/1963 Simjian ..... 340/149 A

*Primary Examiner*—Harold Pitts
*Attorney, Agent, or Firm*—Steinberg and Blake

[57] ABSTRACT

A multiple-output electrical matrix system having a plurality of outputs one of which can be selected in accordance with selection of a given combination of inputs, while utilizing only a small amount of power. This matrix system is suitable for use in a safe-deposit box installation where a decoder sends information to the matrix system for actuating the latter to unlock, at least partially, a given safe-deposit box. The decoder receives its information from a card-reader capable of reading information, in code form, on an ID card which has not only a code for identifying a given box but also a code for providing a condition which must be met before a given box can be unlocked. A control circuit is connected between the card-reader and the decoder for transmitting an unlock signal to the latter only when the control circuit detects that the conditional code has the requirement thereof fulfilled. The control circuit is also electrically connected with a time-stamp unit which permits the control circuit to transmit the unlock signal to the decoder only when a time card has an entrance time stamped thereon, this time card also having a portion on which a leaving time is adapted to be stamped.

10 Claims, 7 Drawing Figures

CARD-CONTROLLED LOCK INSTALLATIONS INCLUDING MATRIX CIRCUITS

BACKGROUND OF THE INVENTION

The present invention relates to card-controlled safe-deposit box installations as well as to electrical matrix systems which enable one of a plurality of outputs to be energized in response to selection of a given combination of inputs.

Matrix circuits of this type are used as counting circuits and the like. Such counting circuits are capable of providing an output in accordance with a selected number, for example, but at the present time these circuits require a relatively large operating current as a result of the large number of output terminals required thereby. Thus, conventional circuits of this type have the drawback of requiring a large amount of electrical power for maintaining their normal operating condition so that it is possible to activate the conventional circuit until suitable control signals are supplied. In addition, with such conventional circuits the power or control current which is required increases as the number of outputs are increased.

The present invention also relates to safe-deposit box installations capable of being remotely controlled by utilizing, for example, an electrical matrix system as referred to above. Such safe-deposit box installations are used in banks, hotels, and the like, and it is desirable to provide remote controls for automatically selecting a given individual's safe-deposit box by means of an ID card which identifies the safe-deposit box of the given individual.

In general, a safe-deposit box is provided with two locks, one of which can be unlocked by the caretaker of the installation while the other requires the key of the client who has rented the box. The arrangement is made in such a way that the particular safe-deposit box cannot be opened unless both locks are simultaneously unlocked.

Large-scale safe-deposit box installations of this type require full-time caretakers and also create a considerable amount of trouble and inconvenience. In order to alleviate these conditions it is proposed to provide remote control arrangements to enable the caretaker to remain at one location so that the caretaker need not travel to a particular safe-deposit box whenever a given client wishes to have his box unlocked. In order to provide such a remote control system, the simplest arrangement would be one where the caretaker can select and operate the box which is to be opened for a given client by way of depression of a switch-button, for example. However, it is inevitable that with such a simple system there will be human error in the selection of a given switch-button so that erroneous partially unlocking of a box which should remain completely locked will occur. Once such an erroneous operation is carried out, the box which is unintentionally partially opened will remain with the caretaker's lock unlocked, so that under these conditions such a box will not be maintained in its locked condition with a high degree of reliability.

One of the further problems encountered with such safe-deposit box installations is the reliable maintenance of records showing when a given individual entered and left the establishment, so as to avoid the possibility of dealing stolen goods, for example. Thus, if reliable records in connection with the entrance and departure of given individuals are not kept, a secure management of a safe-deposit box installation is not possible since otherwise highly undesirable events can easily occur.

Such keeping of records in connection with arrival and departure of individuals who utilize the installation are extremely troublesome to the caretaker and creates particular difficulties in the event that several individuals are simultaneously on hand for simultaneously utilizing their safe-deposit boxes.

SUMMARY OF THE INVENTION

It is accordingly a primary object of the present invention to provide a card-controlled lock installation with an electrical matrix system of the above general type which on the one hand will utilize only a small amount of power while at the same time making it possible to select from a large number of outputs, with an increase in the number of outputs requiring no additional power.

Also, it is an object of the present invention to provide a system for effectively enabling a safe-deposit box installation to be controlled remotely by a caretaker while assuring an operation where the caretaker cannot carelessly cause the wrong box to have its caretaker's lock unlocked.

In addition, it is an object of the invention to provide a safe-deposit box installation which will effectively keep reliable records of the arrival and departure of individuals utilizing the installation, even if a relatively large number of individuals are simultaneously on hand for simultaneously utilizing their safe-deposit boxes, while creating no particular inconvenience or difficulty on the part of the caretaker in connection with keeping of such records.

According to the present invention, the card-controlled lock installation includes an electrical matrix system having a plurality of primary switching means each of which has a primary input means and a primary output means connected thereto so that in response to actuation of a given primary input means, a given primary output means will receive a signal. A plurality of secondary switching means are provided, and the plurality of secondary switching means are divided into groups according to which all of the secondary switching means of a first group correspond to the first of a sequential series of items, while all of the secondary switching means of the second group correspond to a second of the sequential series, and so on. The number of secondary switching means of each group correspond to the number of primary switching means and the plurality of secondary switching means of each group are respectively connected electrically to the plurality of primary output means. A plurality of secondary input means are respectively connected to the several groups of secondary switching means with each secondary input means being electrically connected in common to all of the secondary switching means of the group to which it is connected. All of the secondary switching means respectively have a plurality of secondary output means connected thereto. As a result of this arrangement when a given primary input means and a given secondary input means are actuated, only one particular secondary output means will receive a signal.

A matrix system of the above general type is capable of being used in a safe-deposit box installation where the matrix means receives a signal from a decoder means which in turn receives a signal from a card-reader means adapted to receive an ID card and to read information which is carried thereby in code form. This information includes an identifying code for identifying a given safe-deposit box and a conditional code for including on a given card at least one condition which must be met before a given safe-deposit box can be opened. A control circuit means is electrically connected between the card-reader means and the decoder means for detecting when the condition of the conditional code has been satisfied, and only then does the control circuit means transmit to the decoder a signal permitting transmission of information to the matrix for providing an unlock signal for a given safe-deposit box. In addition, a time-stamp means is electrically connected with the control circuit means for transmitting thereto a signal permitting operation of the decoder means only when a time card is received by the time-stamp means. Under this latter condition the control circuit transmits to the time-stamp means a signal for stamping an entrance time on the time card. This time card also has a portion for receiving a leaving time, and this latter portion is capable of being acted upon by the time-stamp means for stamping on the time card the time when a given individual departs from the safe-deposit box installation.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
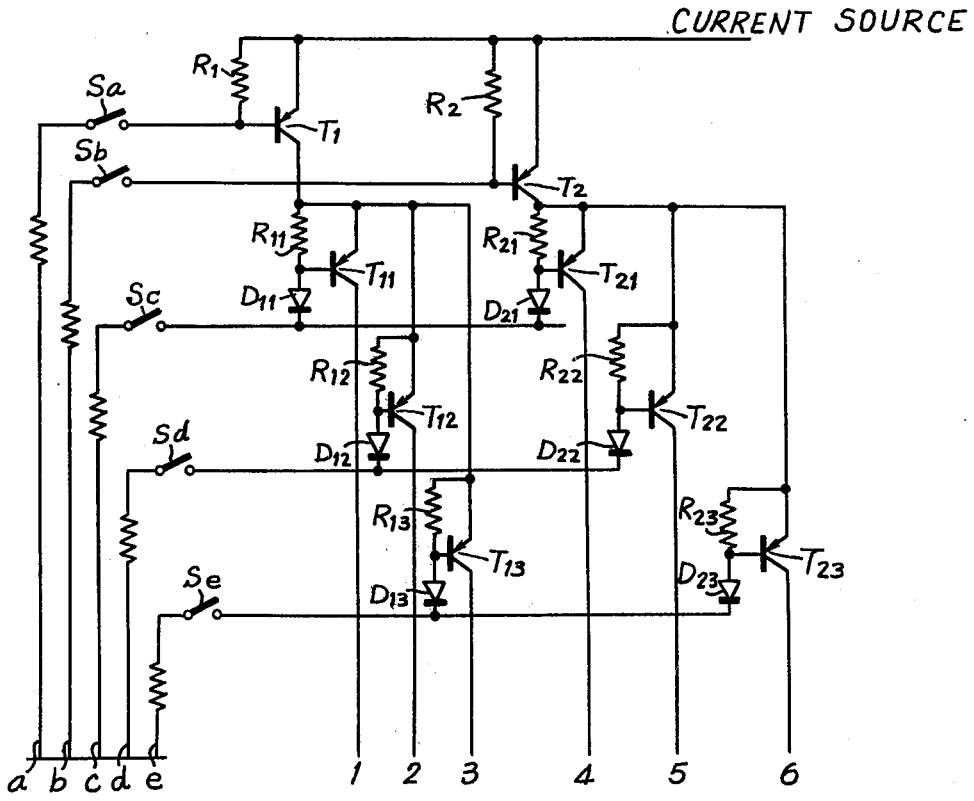
FIG. 1 is a wiring diagram illustrating the principles on which an electrical matrix system of the present invention are based.

Referring to FIG. 1, the electrical matrix system illustrated therein includes a plurality of primary switching means, and in the example of FIG. 1 there are illustrated two such primary switching means $T_1$ and $T_2$ in the form of transistors, as illustrated. The primary switching means $T_1$ and $T_2$ have primary output means which include their collectors, and these primary output means are respectively connected with a plurality of secondary switching means. Thus it will be seen from FIG. 1 that the output means of the primary switching means $T_1$ is electrically connected with a plurality of secondary switching means $T_{11}$, $T_{12}$, and $T_{13}$ which are respectively also in the form of transistors, and the latter transistors have their emitters all connected in common to the primary output means of the primary switching means $T_1$. It will also be noted that the emitters of the transistors $T_{11}$, $T_{12}$, and $T_{13}$ are electrically connected with their bases through biasing resistors $R_{11}$, $R_{12}$, and $R_{13}$, respectively, so that the several transistors $T_{11}$, $T_{12}$, and $T_{13}$ are self-biased in this way. Diodes $D_{11}$, $D_{12}$ and $D_{13}$ are also connected to the bases of the transistors which form the plurality of secondary switching means $T_{11}$, $T_{12}$, and $T_{13}$, for the purpose of providing a stable operation and also for the purpose of preventing excessive, unnecessary circulating current as will be apparent from the description below, so that in this way there will be a decrease of useless power loss. The primary switching transistor $T_1$ is also self-biased by way of a resistor $R_1$ connected between its emitter and base, and in addition the emitter of the switching transistor $T_1$ is connected to a required current source.

The above-described circuitry may be considered as the $T_1$ system of the illustrated network. The $T_2$ system is constructed in the same way. Thus, the primary output means of the primary switching means $T_2$, which includes the collector thereof, is connected in common to the emitters of the plurality of secondary switching means $T_{21}$, $T_{22}$, $T_{23}$, in the form of the illustrated transistors, with this circuitry $T_2$ system being identical with that of the $T_1$ system. Thus it will be seen that all of the transistors $T_2$, $T_{21}$, $T_{22}$, and $T_{23}$ are self-biased through the resistors $R_2$, $R_{21}$, $R_{22}$, and $R_{23}$, while in the same way the bases of the transistors which form the secondary switching means $T_{21}$, $T_{22}$, and $T_{23}$ are electrically connected with the illustrated diodes $D_{21}$, $D_{22}$, and $D_{23}$, which operate in the same way as the diodes $D_{11}$, $D_{12}$, and $D_{13}$.

A pair of input means *a* and *b* are electrically connected with the primary switching means $T_1$ and $T_2$, respectively, in order to actuate the latter by providing input signals thereto, the primary input means a and b respectively including the actuating switches Sa and Sb, as illustrated in FIG. 1. It will be seen that in the example of FIG. 1, the several secondary switching means are divided into three groups each of which includes a number of secondary switching means equal to the number of primary switching means. Thus, the pair of secondary switching means $T_{11}$ and $T_{21}$ form the first group and may be considered as corresponding to the first of the items of a sequential series of items, while the transistors $T_{12}$ and $T_{22}$ form the second group and correspond to the second of the series of sequential items, while at the same time the transistors $T_{13}$ and $T_{23}$ form the third group and correspond to the third of the series of sequential items. Thus, this series of sequential items may form a numerical series, for example. A secondary input means *c* is connected electrically with the first group of secondary switching means $T_{11}$ and $T_{21}$, being common to the switching transistors of this first group. Thus it will be seen that the secondary input means *c* is connected in common to the bases of the secondary transistors $T_{11}$ and $T_{21}$ of the first group of secondary switching means, with this secondary input means *c* being connected to these bases through the diodes $D_{11}$ and $D_{21}$. The secondary input means *c* includes an operating switch Sc which may be closed for actuating this secondary input means so as to transmit input signals to the group of secondary switching means $T_{11}$ and $T_{21}$. In the same way a secondary input means *d* is connected in common to the bases of the second group of secondary switching means $T_{12}$ and $T_{22}$, through the diodes $D_{12}$ and $D_{22}$ with this secondary input means *d* including an operating switch Sd. In the same way a secondary input means *e* includes an operating switch Se and is electrically connected through the diodes $D_{13}$ and $D_{23}$ to the bases of the transistors $T_{13}$ and $T_{23}$ which form the third group of secondary switching means.

The several secondary switching means are respectively provided with a plurality of secondary output means 1–6, as illustrated in FIG. 1, with the several secondary output means 1–6 respectively including the collectors of the several transistors which form the plurality of secondary switching means.

In order to provide a signal at a predetermined one of the several secondary output means, a given combination of a primary input means and a secondary input means are actuated. Thus, assume that the switch Sa the switch Sc are both simultaneously closed, so as to actuate the primary input means *a* and the secondary input means *c*, then it will be seen that a current flows between the collector and base of the primary switching transistor $T_1$, thus turning the transistor $T_1$ on, so that, as a result of the presence of the biasing resistor $R_{11}$, a bias voltage is applied to the transistor $T_{11}$ causing a current to flow between the collector and base of the secondary switching means formed by the transistor $T_{11}$. As a result the transistor $T_{11}$ is also turned on and an output will appear at the secondary output means 1. At this time only the transistors $T_1$ and $T_{11}$ are turned on, with all of the other transistors remaining in their off state, with no change occuring therein.

If a diode were not connected to the base of each of the secondary transistors, then the turning on of the transistor $T_1$ would cause a circulating current to flow through the bias resistors $R_{11}$, $R_{21}$, $R_{22}$, and $R_{12}$ to flow into the transistor $T_{11}$ which is in its turned on state. Accordingly each diode is inserted in the circuitry of FIG. 1 in order to avoid power loss which otherwise would result from such circulating current.

An output signal can be provided at the secondary output means 2 by closing the switches S*a* and S*d*, while an output signal can be provided at the secondary output means 3 by closing the switches S*a* and S*e*.

In the same way, an output signal can be provided at the secondary output means 4 by simultaneously closing the switches S*b* and S*c*, at the secondary output means 5 by simultaneously closing the switches S*b* and S*d*, and at the secondary output means 6 by simultaneously closing the switches S*b* and S*e*. Thus, as is apparent from the above description only two transistors operate for selecting any given output terminal so that the power loss is greatly decreased with the circuitry of the invention.

Figure 2:
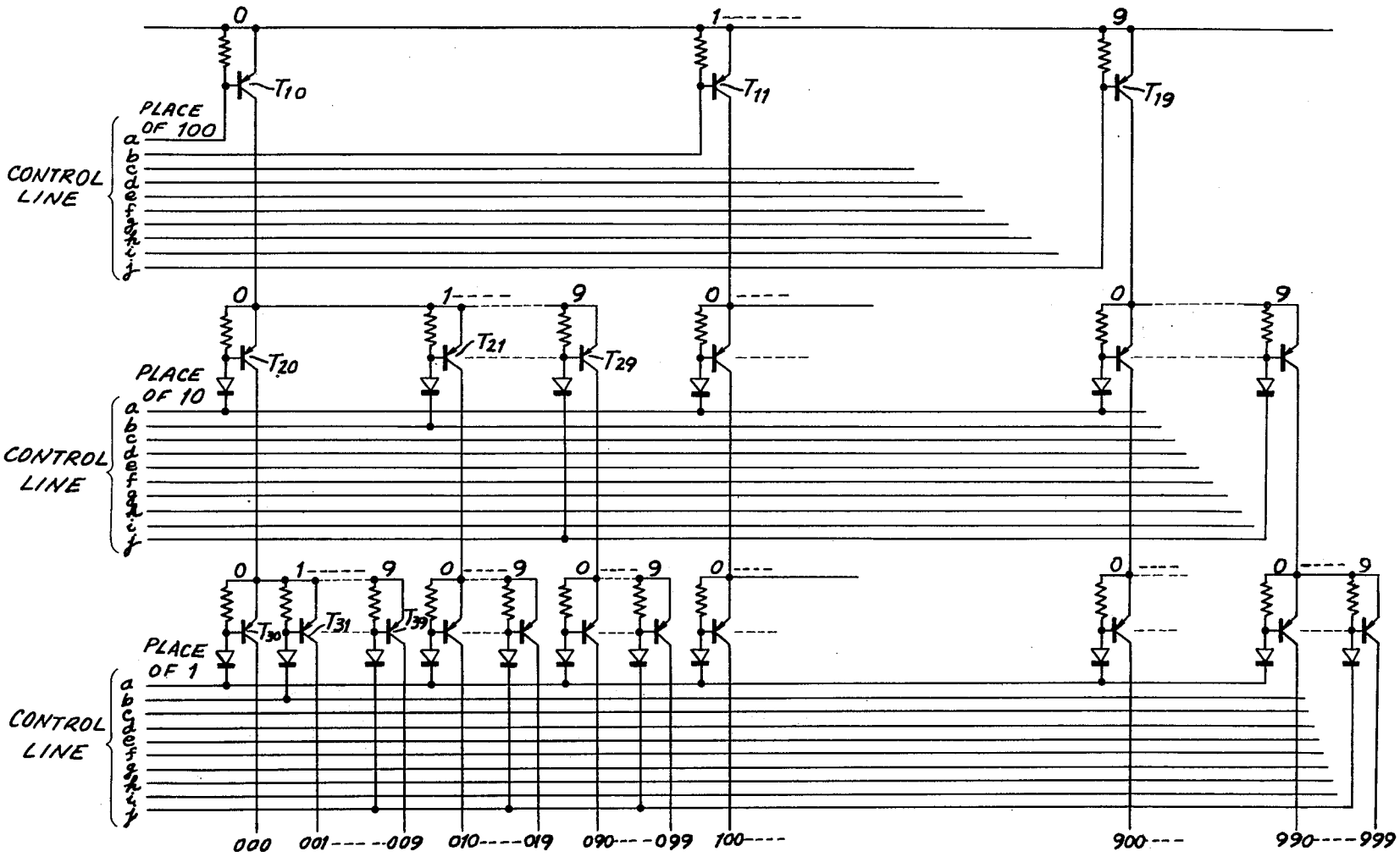
FIG. 2 shows an example of an electric matrix system of the invention utilizing arrangements of the type shown in FIG. 1.

FIG. 2 illustrates by way of example how the principles of the invention illustrated in FIG. 1 may be applied. In the example of FIG. 1, the elctrical matrix circuit of the invention is used in connection with a plurality of output means corresponding to a numerical series. The lowermost circuitry of FIG. 2 correspond to the ones, the central circuitry of FIG. 2 corresponds to the tens, and the uppermost circuitry of FIG. 2 correspond to the hundreds of the numerical series, so that the uppermost circuitry of FIG. 2 includes the plurality of primary switching means, the intermediate circuitry of FIG. 2 includes the plurality of secondary switching means, and the lowermost circuitry of FIG. 2 includes a plurality of tertiary switching means. This circuitry is arranged in such a way as to provide an increase in the manner of an exponential function with a specific dominating acting transistor such as the primary switching transistor $T_{10}$ serving as a reference. Thus an increase is made in the manner of a function $10^x$ (where $x$ is an integer) with one transistor serving as a reference. In this example, however, it is determined that $x = 1 \sim 2$.

Referring to FIG. 2 it will be seen that the collector of the dominant or primary switching transistor $T_{10}$ is connected in common to the emitters of the plurality of secondary switching transistors $T_{20}, T_{21}, \ldots T_{29}$, so that the primary output means of the primary switching transistor $T_{10}$ is in this way connected to the emitters of the plurality of secondary switching means $T_{20} - T_{29}$. In this way the primary switching means $T_{10}$ corresponding to the first of the hundreds digits is electrically connected to the first group of secondary switching means which correspond to the first of the sequential series of items which correspond to the sequential series of tens. The secondary output means which includes the collector of each of the secondary transistors $T_{20} - T_{29}$ are connected to the several groups of tertiary switching means which form the ones of the numerical series. Thus it will be seen that the secondary switching transistor $T_{20}$ has its collector electrically connected with the emitters or the tertiary transistors $T_{30} - T_{39}$ which correspond to the ones of the numerical series. The collectors of the several tertiary switching means $T_{30} - T_{39}$ respectively form parts of the tertiary output means 000, 001, . . . 009, as illustrated in FIG. 2 of the lower left part thereof. Thus, in the illustrated example there are ten sets of ten tertiary switching transistors each, and these ten sets of tertiary transistors are all respectively provided with their individual output means. Moreover, there is one $T_{10}$ system, a second $T_{11}$ system identical with the $T_{10}$ system, and so on up to the $T_{19}$ system. Moreover it will be noted that each group of tertiary switching means has with respect to the secondary switching means to which it is connected the same relationship that each group of secondary switching means has with respect to the primary switching means to which it is connected. Thus, in the illustrated circuit there are $T_{10} - T_{19}$ primary switching means each of which dominates over 100 input terminals, and in the entire arrangement there are 1000 output terminals.

The several primary switching means $T_{10} - T_{19}$, corresponding to the hundreds place, respectively have their own individual input means $a - j$, as illustrated at the upper part of FIG. 2. Moreover, at the plurality of secondary switching means there are also ten input means $a - j$, but in this case it will be seen that the input means *a* is electrically connected, through diodes in the same way as described above in connection with FIG. 1, to the bases of all of the secondary switching transistors which form the first group corresponding to the first of the sequential series of items. Thus it will be seen that the secondary input means *a* illustrated at the intermediate level in FIG. 2 is connected in common to the first of the several groups of ten transistors which are respectively connected with the plurality of primary transistors $T_{10} - T_{19}$. The input means *b* of the intermediate circuitry shown in FIG. 2 is connected in common to the second of the sequential series which forms the second group all of which are also connected to the plurality of primary output means, respectively, as described above in connection with FIG. 1 and as illustrated in FIG. 2. This arrangement follows for all of the several secondary input means. At the lowest part of FIG. 1 are shown the several tertiary input means *a – j*, and it will be seen that this lowermost input means *a* is connected in common to the first of the several groups of tertiary transistors which are respectively connected to the plurality of secondary output means, so that the tertiary circuitry has with respect to the secndary circuitry the same relationship that the secondary circuitry has with respect to the primary circuitry.

For the sake of convenience it is assumed that signals corresponding to the sequential numerals 0 – 9 are capable of being respectively supplied to each of the illustrated groups of input means *a – j*. Thus, assuming that each of the three illustrated input means *a* are simultaneously actuated, when it will be seen that the transistors $T_{10}$, $T_{20}$, and $T_{30}$ are simultaneously turned on, so that an output 000 is obtained. Assuming now that the upper and intermediate input means *a* are maintained actuated and that at the ones place the input means *b* is simultaneously actuated, then in the ones place an input signal is provided at the place corresponding to the numeral 1, and an output in this case will be provided at the tertiary output means 001. If in the hundreds group the input means *j* is actuated, while at the tens and ones groups the pair of input means *a* are simultaneously actuated, when the tertiary output means 900 will receive a signal, as is apparent from FIG. 2. Thus, with this particular example of the invention it is possible to provide outputs of 000 ~ 999. Whichever outputs are selected, only three transistors, one for each of the three places of the selected output, will operate at any one time.

Thus, according to the present invention it is possible to achieve the necessary output through operation of a minimum number of switching means, and only an extremely small amount of electrical power is required. Furthermore, if, for example, an arrangement having 500 output terminals is constructed as described above and thereafter the number of output terminals are increased, then the number of transistors to be actuated at any one time does not change, and electrical power required for the input from the control line does not change in any way. Furthermore, the insertion of a diode at the input connection to all of the transistors except the primary transistors, as described above prevents power loss due to unnecessary circulating current. Thus, with the invention it is possible to achieve the advantage of a matrix circuit having only a small electrical power consumption.

Figure 3:
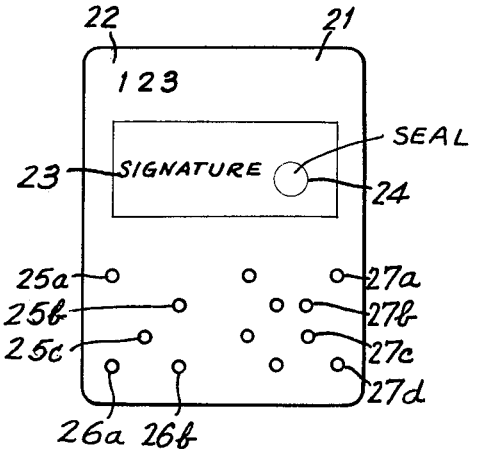
FIG. 3 is a schematic illustration of an ID card capable of being used in a safe-deposit box installation which also is adapted to use systems of the type shown in FIGS. 1 and 2.
Figure 4:
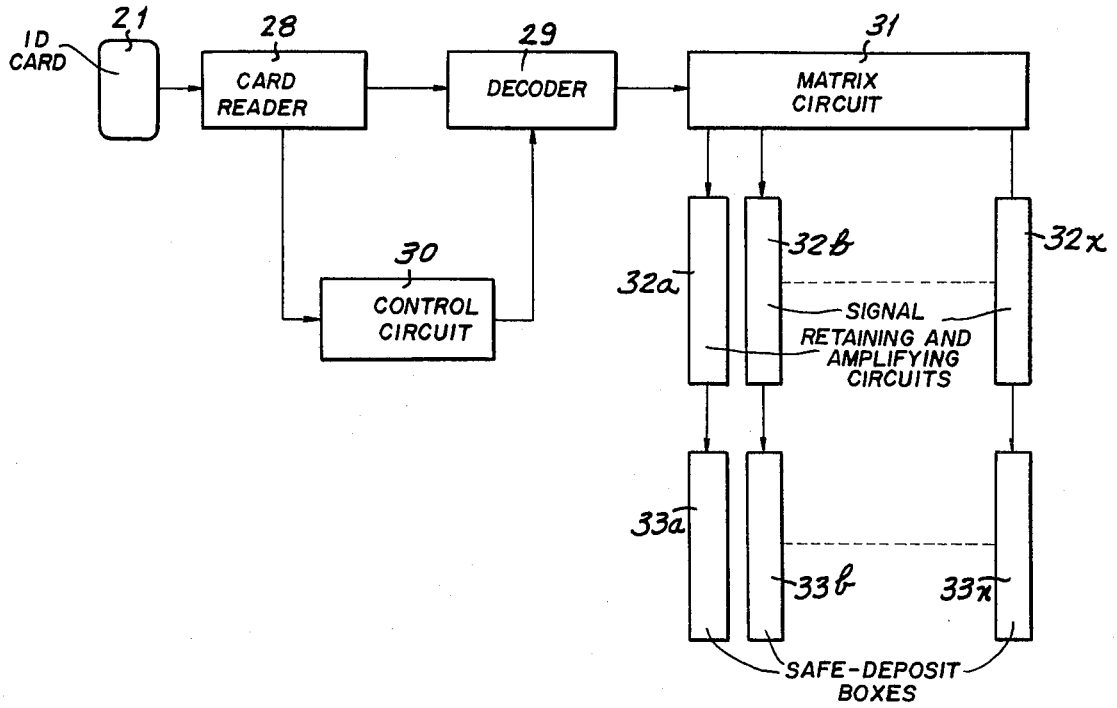
FIG. 4 is a schematic block diagram showing a safe-deposit box installation of the invention utilizing the ID card of FIG. 3 and also capable of utilizing a matrix system as shown in FIGS. 1 and 2.

Referring now to FIGS. 3 and 4, there is illustrated therein a safe-deposit box installation according to the invention capable of utilizing an electrical matrix system as described above in connection with FIGS. 1 and 2. FIG. 3 illustrates an ID card made of a simple material such as a hard vinyl chloride resin. On the main body of the card 21, at its upper portion, there is a space for the safe-deposit box number 22. At the central upper region of the card 21 is a space for the name 23 as well as a space for an identifying seal 24. At the lower left portion of the card 21, as viewed in FIG. 3, there is a conditional code means which includes the code components 25*a*, 25*b*, 25*c*, this particular conditional code means serving to identify a specific safe-deposit box arrangement so as to prevent erroneous use of the ID card among a plurality of different safe-deposit box arrangements. For example, different banks or groups of safe-deposit boxes may have the same numbers, with such banks or groups being situated at different branches of the same institution, for example, or even at different parts of the same institution, so that it is necessary to make certain that the particular safe-deposit box number is used for the proper box in the proper group of boxes. The conditional code means also may include additional code components 26*a*, 26*b*, which may serve to set forth, in code form a particular condition which must be satisfied before a particular safe-deposit box can be opened. For example, the additional code means 26*a*, 26*b* may specify that, according to a specific contract, the particular safe-deposit box must not be unlocked unless a plurality of specific individuals are simultaneously present.

At the lower right portion of the card 21, as viewed in FIG. 3, is an identifying code means 27*a*, 27*b*, 27*c*, 27*d*, this identifying code means representing the identification of a specific safe-deposit box and corresponding, for example, to the numerical identification 22 appearing at the top of the card. Alternatively, the space 23 for the name and the space 24 for the seal may be provided in the form of a sheet of paper or the like which is pasted onto the card 21.

FIG. 4 shows by way of a block diagram one possible example of a safe-deposit box installation according to the present invention. As is schematically indicated in FIG. 4, the ID card 21 is adapted to be received by a card-reader means 28 which is of a known construction capable of reading all of the codes on the card 21. This card-reading means 28 is operatively connected with a decoder means 29 which is also of a known construction and which is capable of converting the codes read by the card-reading means 28 (binary codes) into suitable codes according to numerical notation with radix N (for example octave codes, decimal codes, hexadecimal codes, etc.). A control circuit means 30 is electrically connected between the card-reader means 28 and the decoder means 29. The control circuit means 30 detects and responds to the conditional code means 25*a*, 25*b*, 25*c*, 26*a*, 26*b* to prevent inadvertent unlocking of the box identified by the identifying code means 27*a*–27*d* by way of this identifying code means alone. An electrical matrix circuit system 31, which may correspond to the system described above in connection with FIGS. 1 and 2, is electrically connected with the decoder means 29 for receiving therefrom a signal for selecting one of a number of safe-deposit boxes 33*a*, 33*b*, . . . 33*x*. Actually, the matrix means 31 will serve to unlock the caretaker's lock of the selected safe-deposit box. Interposed between the several boxes and the matrix means 31 are a plurality of circuits 32*a*, 32*b*, . . . 32*x*, respectively connected between the several boxes and the matrix means for the purpose of receiving directly the signals from the matrix means 31 and amplifying and self-retaining these signals.

Each client has an ID card 21, with the arrangement being such that if the conditional code means 26*a*, 26*b* requires that several individuals must be simultaneously present to open a given box, then the box cannot be unlocked unless all of the ID cards of the several individuals are simultaneously inserted into the card-reader means 28.

The codes on the cards may be memorized by various means such as photoelectric transformation means, magnetic means, etc. The present invention is not restricted to any specific memorizing means.

As a rule, for a given safe-deposit box the caretaker has on hand one ID card on which there is the signature and seal of the particular client, while the client possesses his own key.

The above-described safe-deposit box installation operates as follows:

First the client fills an application for use of the particular safe-deposit box, handing in a signed and sealed application form (not shown) as well as the client's key. The caretaker then checks the signature and seal of the applcation form with those of the ID card. In the event that these signatures and seals do not coincide with each other then the caretaker will inquire of the client as to the reason why there is no coincidence of these identifying signatures and seals. If the particular answer given by the client is suspicious, the caretaker will of course refuse to unlock the caretaker's lock.

Assuming, however, that there is no grounds for suspicion, then the caretaker will further check the specific contract condition, which is on the card by way of the conditional code means described above. In the event that there is no objectionable point raised by a specific condition which must be met before the box is opened, then the caretaker will insert the ID card 21 into the card-reader means 28 so that the latter will read out the codes on the ID card. The control circuit means 30 will check as to whether the particular ID card 21 is one which is to be properly used only for this particular safe-deposit box arrangement or group, and further as to whether any specific contract condition is satisfied. Assuming that the conditions of the conditional code means are satisfied, then the control circuit means will automatically operate to provide an unlock signal to the decoder means 29 and thereupon the decoder means 29 will effectively send signals corresponding to the identifying code means 27*a*–27*d* to the matrix circuit 31. Thus, through the code means 27*a*–27*d* a specific safe-deposit box is selected, and an unlock signal is transmitted to this particular safe-deposit box. This unlock signal is amplified and self-retained by the circuitry 32*a*–32*x*, and then the unlock signal is sent to the particular safe-deposit box 33*a*–33*x*, maintaining the caretaker's lock unlocked for a given period of time.

Even if the caretaker should overlook a specific contract condition which should be met before opening a particular box, the control circuit means 30 will inspect the code means 26*a*, 26*b*, and the output of the decoder means 29 will not be transmitted to the matrix means 31 unless the requirements of the specific condition are met. The control circuit means 30 also inspects as to whether the particular ID card 21 is correctly applied to the particular group of safe-deposit boxes identified by the conditional code means 25*a*–25*c*. Thus, a specific safe-deposit box can only be unlocked when the requirements of the particular conditions of the conditional code means are satisfied.

Thereafter, the client will unlock the client's lock of the particular rented safe-deposit box with his own key and will then make the desired use of the contents of the safe-deposit box.

Thus, as is apparent from the above description, when the caretaker inserts the ID card 21 into the card-reader means 28, a remote control action through the identifying code means 27*a*–27*d* of the ID card 21 makes it possible to unlock correctly the paticular safe-deposit box of a particular client. In addition, the conditional code means set forth in code form conditions which are essential to be satisfied before the particular safe-deposit box can be unlocked, with this conditional code means being inspected by the control circuit means 30 so that the caretaker need not fear that through error he will cause the incorrect safe-deposit box to be unlocked.

Therefore, with the present invention it is possible to achieve the advantage of checking the particular client very effectively while it is possible for one caretaker to manage a large number of safe-deposit boxes in an efficient and secure manner with very little inconvenience even if a number of clients are simultaneously present to use their safe-deposit boxes. In this way the waiting time required for such clients can be decreased and one caretaker can carry out a large number of operations, practically simultaneously, in a highly effective manner.

Figure 5:
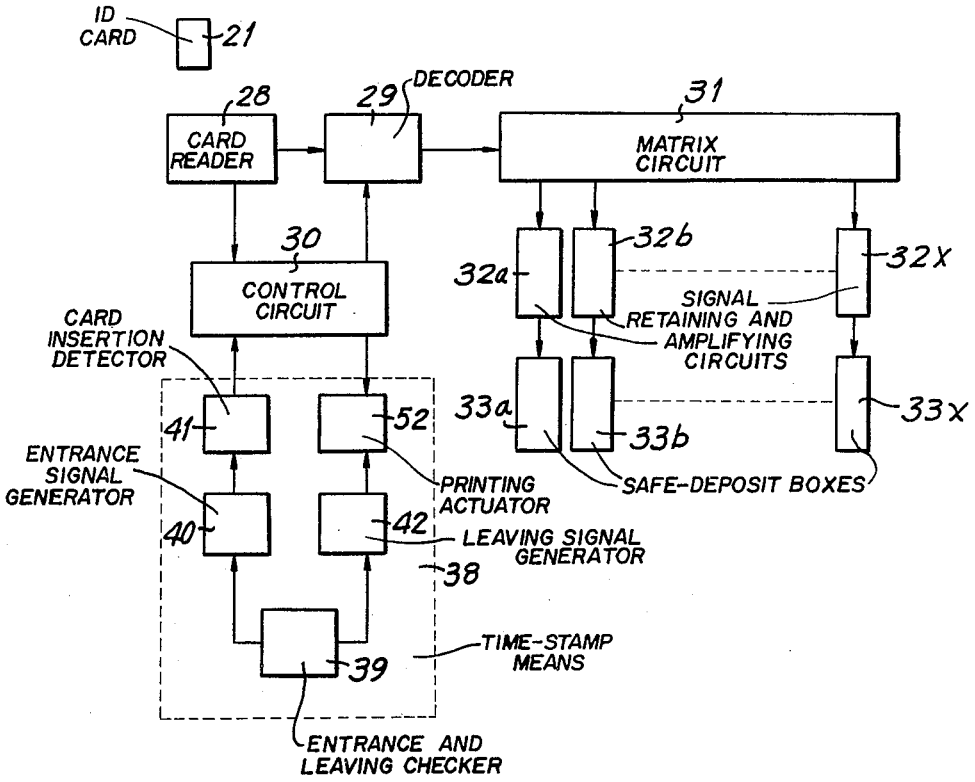
FIG. 5 shows a system as illustrated in FIG. 4, in a schematic block diagram, further extended by the use of a time-stamp means.

Referring now to FIG. 5 there is illustrated therein the same arrangement as is illustrated in the block diagram of FIG. 4, but in FIG. 5 the installation includes a time-stamp means 38. Thus, FIG. 5 shows the ID card 21 together with the card-reader means 28 and the decoder means 29, with the control circuit means 30 electrically connected therebetween. The decoder means 29 of course transmits the signal as described above to the matrix means 31 which is connected as described above through the amplifying and self-retaining circuitry components 32*a*–32*x* to the caretaker's locks of the several boxes 33*a*–33*x*.

In the installation of FIG. 5, however, the control circuit means 30, in addition to carrying out operations as described above in connection with FIG. 4, does not transmit the unlock signal to the decoder means 29 until the control circuit means 30 receives a signal from the time-stamp means 38 indicating that a time-stamp card 50 (FIG. 7) has been inserted into the time-stamp means 38. It is only when such a time-stamp card has been received by the time-stamp means 38 that the control circuit means 30 will transmit to the decoder means 29 the signal required to enable the decoder means to transmit the identifying information to the matrix means 31. In the embodiment of FIG. 5 the control circuit means 30, in addition to sending such a signal to the decoder means 29, operates to return to the time-stamp means a signal which triggers the time-stamp means 38 to stamp a given entrance time on the card 50.

The time-stamp means 38 includes a checking means 39 capable of checking the entrance and leaving of a given individual, and in accordance with such checking operations the means 39 will actuate an entrance-signal generator 40 or a leaving signal generator 42. A signal from the entrance-signal generator 40 will actuate a card-insertion detector 41. When a time-stamp card 50 is received by the time-stamp means 38, the card-insertion detector 41 detects the presence of the card and sends a card-insertion signal to the control circuit means 30. As mentioned above, if there is no particular objection with respect to a particular ID card 21, then the control circuit means 30 will transmit a time-stamp signal back to the time-stamp means 38. Upon receiving this latter signal, the time-stamp means will print the time of entrance on the time-stamp card 50. In a manner described in greater detail below, when the individual leaves, the checking means 39 will actuate the leaving signal generator 42 which sends a stamp signal directly to a printing actuator means 52. Thus, upon entering the installation the stamp signal is derived at the printing actuator 52 from the control circuit means 30, while when departing from the installation, the leaving signal is transmitted to the actuator 52, not by way of the control circuit means 30, but instead directly so that the time of departure is immediately stamped or printed on the time-stamp card 50.

Figure 6:
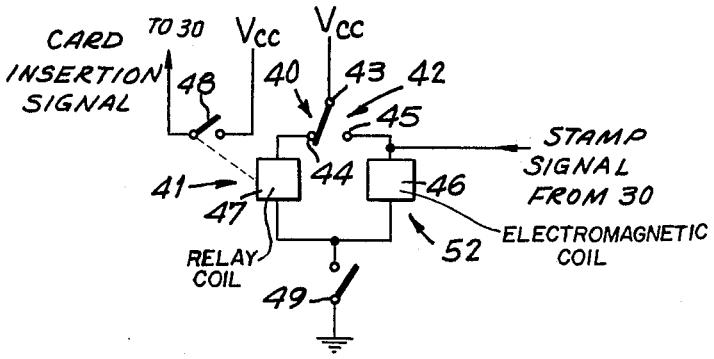
FIG. 6 is a schematic wiring diagram of part of the time stamp means of FIG. 5.

FIG. 6 illustrates in greater detail the circuitry of the entrance-leaving checking means 39. Thus, it will be seen that FIG. 6 shows schematically the entrance signal generator 40, the card-insertion signal detector 41, the printing actuator 52, and the leaving-signal generator 42. The entrance and departure signal generators 40 and 42 have in common a change-over switch 43 supplied from a voltage source Vcc. The terminal 44 of the change-over switch 43 constitutes with the latter the entrance-signal generator 40 while the terminal 45 together with the switch 43 constitutes the leaving-signal generator 42. Thus, depending upon the position of the switch 43, the current source voltage Vcc will be applied either to the entrance terminal 44 or to the departure terminal 45. The position of the switch 43 is determined by the entrance-leaving checker means 39, and the switch 43 normally has the position shown in FIG. 6 where it engages the entrance terminal 44. However, in order to complete the circuit it is necessary for a card-insertion detecting switch 49 of the means 39 to be closed, as is apparent from FIG. 6. In the circuit between the card-detecting switch 49 and the departure terminal 45 is an electromagnetic coil 46 which forms part of the printing actuator 52, this coil 46 forming part of a solenoid or relay for causing the time to be printed when the coil 46 is energized. As is shown at the right of FIG. 6, the coil 46 can be energized by way of the stamp signal from the control means 30, or directly by way of the terminal 45. However, in either event it is necessary first for the card-detecting switch 49 to be closed. Thus, whenever the switch 49 is closed, when a time-stamp signal is received from the control circuit 30 the time-stamp means 52 will be triggered to print the time by way of energizing of the coil 46, and upon departure the same tripping of the time-stamp means 52 will be provided by way of the terminal 45.

Between the entrance terminal 44 and the switch 49 is a relay coil 47 which will of course become energized as soon as the switch 49 closes with the circuitry in the position shown in FIG. 6. The relay coil 47 controls a switch 48 which is connected to the voltage source Vcc as well as to the control circuit means 30 to transmit to the latter a card-insertion signal when the switch 48 is closed by energizing of the coil 47. Thus, with the parts in the position shown in FIG. 6, when a client inserts the time card 50 into the time-stamp means 38 the switch 49 will be closed by the card 50 and the switch 48 will be automatically closed in order to transmit to the control circuit means 30 a signal indicating that a time card has been properly inserted into the time-stamp means, and thereafter the time-stamp signal will be transmitted back to the time-stamp means 38 assuming that the conditions of the conditional code means are satisfied as described above.

Figure 7:
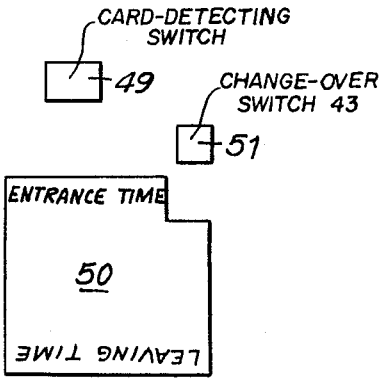
FIG. 7 is a schematic illustration of the manner in which a time card controls part of the circuitry of FIGS. 5 and 6.

As is apparent from FIG. 7, the time card 50 has an upper portion, as viewed in FIG. 7, for receiving the printing which indicates the entrance time and a lower portion, as viewed in FIG. 7, for receiving the printing which indicates the departure or leaving time. These opposed portions of the time card 50 have different configurations as illustrated. Either end of the time card 50 will close the switch 49, as is apparent from the schematic illustration of FIG. 7 according to which the time card is advanced upwardly as viewed in FIG. 7, in order to close the switch 49 either with the entrance-time end or with the leaving-time end of the card. However, the circuitry includes the switch 51, which is a schematic illustration in FIG. 7 of the change-over switch 43. The position of this switch 51 is such that it will not be engaged by the time card 50 when the entrance-time end thereof is introduced in order to close the switch 49. It will be seen from FIG. 7 that the entrance-time end of the card 50 is shorter than the leaving-timing end thereof, so as to leave at the time card 50 a cut-away portion or notch in which the switch 51 will be situated when the entrance-time end of the card 50 is introduced into the time-stamp means 38. However, when the card 50 is reversed, the longer leaving-time end of the card will move into the space occupied by the switch 50 and will actuate the latter, so that in this way the time card itself moves the change-over switch 43 so that it will engage the terminal 45 instead of the terminal 44.

As a result of the above arrangement, when the time card 50 is introduced into the time-stamp means to have the entrance time stamped thereon, the change-over switch 43 will remain in the position shown in FIG. 6. However, when the card is reversed, upon departure of the client, then the switch 43 will be changed over to contact the terminal 45. Thus, it is possible to clearly distinguish the entrance and leaving checking operation so that these operations can be effectively carried out by the checking means 39, the details of which are shown in FIG. 6.

Thus, with the above-described structure of FIGS. 5–7, a client who wishes to use a particular safe-deposit box enters the institution and signs and seals the time-stamp card 50 which at the same time serves as an application for use of the particular box which has been rented. The caretaker checks the key which is handed to him by the client and in addition checks the signature of the client and the seal on the ID card 21 with those which appear on the application or time-stamp card 50. Assuming that there is no objection, then the ID card is introduced into the card-reader means 28 which reads out the information on the ID card, and the corresponding signals are transmitted to the decoder means 29 as well as to the control circuit means 30. This control circuit means 30 checks the ID card in the manner described above, and if there is no objection, then the time-stamp card 50 which also serves as the application form is inserted into the time-stamp means 38 with the entrance-time end of the card 50 being foremost. When the card 50 is brought into contact with the detecting switch 49, the checking means 39 will distinguish that the entrance time is to be indicated, and the coil 47 will become energized so as to close the switch 48 and thus transmit the required signal to the control circuit means 30. Thus, the control circuit means 30 receives a signal indicating that a time-stamp card has been inserted into the time-stamp means 38, and upon receiving this signal, if there has been no objectionable point raised in connection with the particular ID card, the control circuit means 30 will send a time-stamp signal back to the time-stamp means 38 in order to energize the coil 46 and thus trigger the stamp means 52 to print the entrance time on the card 50. At the same time, the control circuit means will transmit an unlock signal to the decoder means 29 so that the information from the latter wil be transmitted to the matrix circuit means 31 which then causes the caretaker's lock of the particular box to be unlocked so that the client can then unlock his own lock on the particular box and use it.

Thus, not only does the caretaker check as to whether there is any objectionable point with respect to the particular ID card, such as with respect to the signal and seal thereof, but further checking is carried out by way of the control circuit means 30. If there is any reason not to permit the particular box to be opened, then the caretaker's lock of the particular box cannot be unlocked and in addition the entrance time is not printed on the time-stamp card. Thus, the presence of the entrance time on the card 50 is an indication that the caretaker's lock has been unlocked.

Thus, with the above arrangement of the invention whenever the caretaker's lock is unlocked, the entrance time is printed on the time-stamp card which has thereon the signature and seal of the client, so that it is almost impossible to use the safe-deposit boxes of the installation of the invention for criminal purposes and thus this latter possibility is very sharply reduced. As a result, the reliability of the installation of the invention is greatly increased as well as the commodity value thereof.

Of course, when a client has completed his use of the box and has returned it, the caretaker's lock will automatically lock after lapse of a given time, in a fully automatic manner which is not described and is a simple time-delay response providing a sufficient time for use of a box and return thereof with locking of the client's lock by the client, whereupon automatically the caretaker's lock will be locked. Then the client will introduce the departure or leaving-time end of the card 50 into the time-stamp means 38 so as to bring about not only closing of the switch 49 as described above, but also changing over of the switch 43 to contact the terminal 45, thus enabling the coil 46 to be energized directly, so that the printing means 52 will be tripped to print on the card 50 the departure time. Of course, the cards are turned in to the caretaker who will of course insist that a given client have the departure time stamped on the card 50 before the client departs from the institution.

What is claimed is:

1. In an installation which includes a matrix system for selecting one of a plurality of outputs from a given combination of inputs, a plurality of primary switching means having a plurality of primary input means electrically connected thereto, respectively, for selectively energizing one of said primary switching means when the primary input means electrically connected thereto is actuated, a plurality of primary output means electrically connected with said plurality of primary switching means, respectively, for providing a signal at that one of said plurality of primary output means which is electrically connected with a selected one of said primary switching means which is energized by actuation of the primary input means electrically connected thereto, a plurality of secondary switching means divided into groups of secondary switching means which form a first group corresponding to the first of a sequential series of items, a second group corresponding to a second of said sequential series of items, and so on, and the number of secondary switching means in each group equalling the number of primary switching means with the plurality of secondary switching means of said first group being respectively connected to said plurality of primary output means, the plurality of secondary switching means of said second group also being electrically connected with said primary output means, respectively, and so on, a plurality of secondary input means being respectively connected electrically with said groups, with each of said secondary input means being common to the plurality of secondary switching means of the group to which it is connected so that upon actuation of a selected one of said plurality of secondary input means, an input signal is transmitted to all of the secondary switching means of the group electrically connected thereto while a primary output signal is received only by that one of the selected group of secondary switching means which is electrically connected with that one of said plurality of primary switching means which is electrically connected with a primary input means which has been actuated, and a plurality of secondary output means electrically connected respectively with all of said plurality of secondary switching means for providing an output signal only from that one of said secondary switching means which is in the group which receives an input signal from a selected secondary input means and which is electrically connected with the primary output means of that one of said primary switching means which receives an input signal from a selected one of said primary input means, a plurality of tertiary switching means divided into groups which include a first group of tertiary switching means corresponding to the first of a sequential series of items, a second group of tertiary switching means corresponding to a second of the sequential series of items, and so on, a plurality of tertiary input means respectively connected electrically with said groups of tertiary switching means with each tertiary input means being common to the plurality of tertiary means of the group to which it is connected, and said groups of tertiary switching means having with respect to said plurality of secondary output means the same relationship that said plurality of secondary switching means have with respect to said plurality of primary output means, and a plurality of tertiary output means respectively connected electrically with said plurality of tertiary switching means so that a given one of said tertiary output means will receive an output signal in accordance with the selected one of said primary input means, secondary input means, and tertiary input means which have been actuated, decoder means electrically connected to all of said primary, secondary and tertiary input means for actuating one of each of said primary, secondary, and tertiary input means according to information decoded by said decoder means, card-reader means electrically connected with said decoder means for transmitting thereto information to be decoded thereby, and an ID card to be received by said card-reader means and carrying a code to be read thereby to provide information to be transmitted to said decoder means, and a plurality of unlockable means such as safety-deposit boxes electrically connected respectively with said plurality of tertiary output means for at least partially unlocking one of said unlockable means which receives a signal from the tertiary output means electrically connected thereto.

2. In a safety-deposit box installation, an ID card carrying an identifying code means for identifying a given safety-deposit box and a conditional code means for providing on said card in code form at least one condition which must be satisfied before a safety-deposit box identified by said identifying code means can be properly opened, card-reader means for receiving said ID card and for reading the codes carried thereby, decoder means electrically connected with said card-reader means for receiving the information read thereby and for decoding said information, control circuit means electrically connected between said card-reader means and said decoder means for responding to the conditional code means read by said card-reader means and for transmitting an unlock signal to said decoder means only when requirements of said conditional code means are satisfied, matrix circuit means electrically connected with said decoder means for receiving therefrom information corresponding to a given safety-deposit box, and a plurality of means electrically connected with said matrix means for partially unlocking a given safety-deposit box in accordance with the identification information transmitted to said matrix means from said decoder means.

3. The combination of claim 2 and wherein a time-stamp means is electrically connected with said control circuit means for permitting the latter to transmit said unlock signal to said decoder means only when a time card is received by said time-stamp means, said control circuit means being electrically connected with said time-stamp means for transmitting thereto a signal for stamping a time when a time card is received by said time-stamp means.

4. The combination of claim 3 and wherein a time card has one portion to be stamped with an entrance time and an opposed portion to be stamped with a leaving time, said portions of said time card having different configurations and the configuration of said other portion of said time card serving to actuate a switch means for operating said time stamp means to stamp the leaving time on said time card.

5. The combination of claim 4 and wherein said one portion of said time card is spaced from said switch means while said other portion thereof engages said switch means so that only said other portion actuates said switch means to stamp the leaving time on said time card.

6. In the matrix means of claim 2 a plurality of primary switching means having a plurality of primary input means electrically connected thereto, respectively, for selectively energizing one of said primary switching means when the primary input means electrically connected thereto is actuated, a plurality of primary output means electrically connected with said plurality of primary switching means, respectively, for providing a signal at that one of said plurality of primary output means which is electrically connected with a selected one of said primary switching means which is energized by actuation of the primary input means electrically connected thereto, a plurality of secondary switching means divided into groups of secondary switching means which form a first group corresponding to the first of a sequential series of items, a second group corresponding to a second of said sequential series of items, and so on, and the number of secondary switching means in each group equalling the number of primary switching means with the plurality of secondary switching means of said first group being respectively connected to said plurality of primary output means, the plurality of secondary switching means of said second group also being electrically connected with said primary output means, respectively, and so on, a plurality of secondary input means being respectively connected electrically with said groups, with each of said secondary input means being common to the plurality of secondary switching means of the group to which it is connected so that upon actuation of a selected one of said plurality of secondary input means, an input signal is transmitted to all of the secondary switching means of the group electrically connected thereto while a primary output signal is received only by that one of the selected group of secondary switching means which is electrically connected with that one of said plurality of primary switching means which is electrically connected with a primary input means which has been actuated, and a plurality of secondary output means electrically connected respectively with all of said plurality of secondary switching means for providing an output signal only from that one of said secondary switching means which is in the group which receives an input signal from a selected secondary input means and which is electrically connected with the primary output means of that one of said primary switching means which receives an input signal from a selected one of said primary input means.

7. The combination of claim 6 and including a plurality of tertiary switching means divided into groups which include a first group of tertiary switching means corresponding to the first of a sequential series of items, a second group of tertiary switching means corresponding to a second of the sequential series of items, and so on, a plurality of tertiary input means respectively connected electrically with said groups of tertiary switching means with each tertiary input means being common to the plurality of tertiary switching means of the group to which it is connected, and said groups of tertiary switching means having with respect to said plurality of secondary output means the same relationship that said plurality of secondary switching means have with respect to said plurality of primary output means, and a plurality of tertiary output means respectively connected electrically with said plurality of tertiary switching means so that a given one of said tertiary output means will receive an output signal in accordance with the selected one of said primary input means, secondary input means, and tertiary input means which have been actuated.

8. The combination of claim 7 and wherein said plurality of primary switching means correspond to the hundreds, said plurality of secondary switching means correspond to the tens, and said plurality of tertiary switching means correspond to the ones of a numerical sequence of items.

9. The combination of claim 6 and wherein each of said primary switching means includes a transistor having a base to which one of said primary input means is electrically connected, a current source connected electrically to the emitters of said transistors of said plurality of primary switching means, and said emitter of each primary switching means being electrically connected with its base and including in the latter electrical connection a biasing resistor so that transistors which form said plurality of primary switching means are self-biased, said plurality of primary output means including collectors of the transistors which form said plurality of primary switching means, said plurality of secondary switching means also being in the form of transistors having emitters electrically connected with said primary output means, and the emitter of each transistor which forms a secondary switching means being electrically connected with its base also through a biasing resistor, with each of said secondary input means being electrically connected with the bases of the group of transistors which form the group of secondary switching means to which each secondary input means is electrically connected, and said plurality of secondary output means respectively including the collectors of the transistors which form the plurality of secondary switching means.

10. The combination of claim 9 and wherein a plurality of diodes are respectively included in the electrical connections between the base of each transistor which forms a secondary switching means and the secondary input means electrically connected thereto, said diodes preventing circulation of current except at a transistor which is energized by a selected one of said primary and a selected one of said secondary input means.

* * * * *